United States Patent [19]

Tracy

[11] Patent Number: 4,971,318

[45] Date of Patent: Nov. 20, 1990

[54] EXERCISE EQUIPMENT WITH DETACHABLE BARBELL WEIGHT

[76] Inventor: James W. Tracy, 352 E. Jarvis, Hazel Park, Mich. 48030

[21] Appl. No.: 410,117

[22] Filed: Sep. 20, 1989

Related U.S. Application Data

[63] Continuation of Ser. No. 218,838, Jul. 14, 1988, abandoned.

[51] Int. Cl.[5] ..... A63B 21/072

[52] U.S. Cl. ..... 272/123; 272/124

[58] Field of Search ..... 272/122, 123, 116, DIG. 6, 272/93, 117, 124; 273/194 B, 72 R, 73 R

[56] References Cited

U.S. PATENT DOCUMENTS

| | | | |
|---|---|---|---|
| 76,944 | 4/1868 | Reilly . | |
| 2,116,655 | 5/1938 | Berrittella | 273/194 B |
| 3,521,883 | 7/1970 | Hamilton | 273/72 R |
| 3,825,253 | 7/1974 | Speyer | 272/84 |
| 3,834,697 | 9/1974 | McNamara, Jr. et al. | 273/73 R X |
| 4,588,191 | 5/1986 | Stewart | 273/194 B |
| 4,639,979 | 2/1987 | Polson | 272/123 X |

*Primary Examiner*—Robert Bahr

*Attorney, Agent, or Firm*—Charles W. Chandler

[57] ABSTRACT

A weight for a barbell comprises a pair of hinged halves which are moveable between open and closed positions. In the closed position, the two halves form an opening for receiving the bar. In the opened position, the two halves permit the weight to be either removed or mounted on the bar without sliding the weight off the end of the bar.

1 Claim, 2 Drawing Sheets

EXERCISE EQUIPMENT WITH DETACHABLE BARBELL WEIGHT

This application is a continuation of application Ser. No. 218,838, filed July 14, 1988, now abandoned.

This invention is related to barbells, and more particularly to a hinged weight that is removable from the bar without being slid off the end of the bar.

Barbells are commonly assembled by mounting several disk-shaped weights on opposite ends of the bar so that the user has a balanced load when lifting the bar and the weights. A problem arises when the user wants to either remove or insert an additional weight to each end of the bar. The usual practice is to unlock and remove a collar mounted on the end of the bar. The bar is then passed through a central opening in the weight.

Different approaches have been suggested in the prior art for mounting a weight on a bar of exercise equipment without having to slip the bar through the central opening. One approach is to employ a weight having a radial slot. This is disclosed in U.S. Pat. No. 76,944 which issued to F. W. Reilly on Apr. 21, 1868.

However, this approach is only useful when the bar is used in a vertical position so that the weight cannot slide off. It is not useful when the bar is used in a horizontal position because the weight can fall off the bar.

U.S. Pat. No. 3,825,253 which issued July 23, 1974 to Henning J. Speyer shows another approach in which a weight has a radial opening. Each weight has interlocking teeth on each face which interlock with similar teeth on neighboring weights.

SUMMARY OF THE INVENTION

The broad purpose of the present invention is to provide an exercising device having a removable weight which comprises a disk-shaped member formed in a pair of hingedly connected halves that are moveable between open and closed positions. In their closed position, the two halves form a central opening for receiving the exercise bar. In such position, the weight is slideable along the bar. A conventional collar is mounted on the bar to prevent the weight from sliding off the bar.

The two halves are moveable to an open position in which they can be removed from the bar without removing the locking collar. A latch, mounted on the two halves, lock them together in their closed position for use during an exercise routine. The latch and the hinge are both mounted within the circular profile of the weight so that the user can drop or roll the weight when mounted on the bar, in the manner well known to those skilled in the art.

Still further objects and advantages of the invention will become readily apparent to those skilled in the art to which the invention pertains upon reference to the following detailed description.

DESCRIPTION OF THE DRAWINGS

The description refers to the accompanying drawings in which like reference characters refer to like parts throughout the several views, and in which.

DESCRIPTION OF THE PREFERRED EMBODIMENTS

Figure 1:
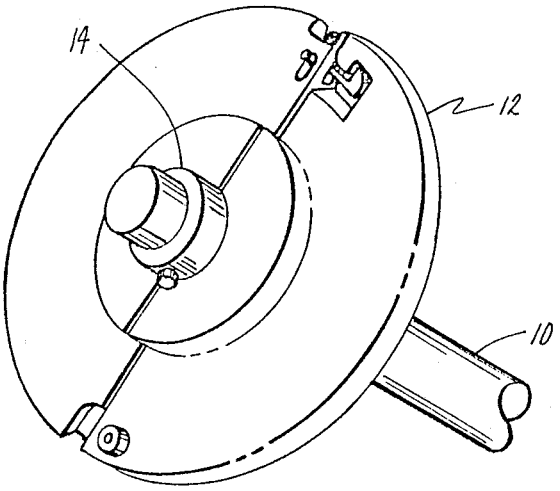
FIG. 1 is a view illustrating a weight mounted on a bar to illustrate the preferred embodiment of the invention.

Referring to the drawings, FIG. 1 illustrates a conventional weight lifting bar 10 of the type in which the user places weights on opposite ends of the bar and then raises the bar in a horizontal position to perform various exercise routines.

A removable weight 12 is mounted on the bar, and a locking collar 14 is mounted on the bar between weight 12 and the end of the bar. Typically several weights may be mounted adjacent the end of the bar and another collar mounted on the opposite side of weight 12 to prevent the weight from sliding along the bar.

Figure 2:
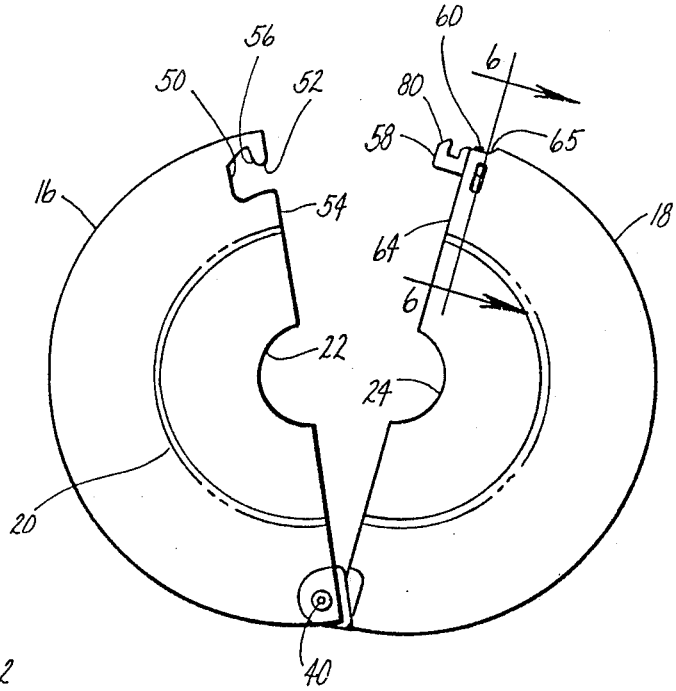
FIG. 2 is a view illustrating the two weight halves in their partially open position.
Figure 4:
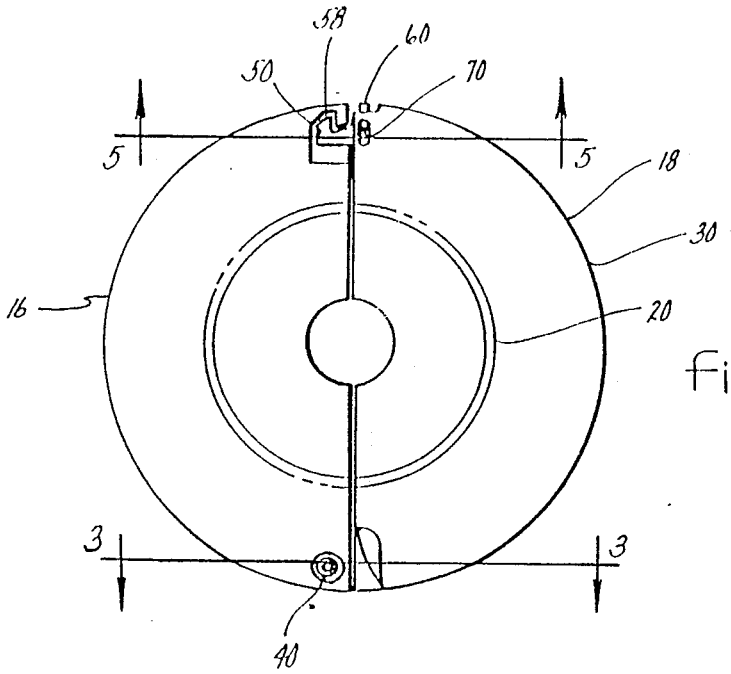
FIG. 4 is a view illustrating the two weight halves in their closed position.

Referring to FIGS. 2 and 4, weight 12 comprises a pair of metal sections 16 and 18, each having a somewhat semi-disk-shaped configuration with a thickened midsection forming a central boss 20 on each face.

The bosses 20 separate the outside rim of each weight from adjacent weights to permit the user to insert his fingers between the weights to open or close them without pinching his fingers between the weights.

Section 16 has an opening 22 adjacent a similarly-shaped opening 24 in section 12 so that when the two sections are adjacent one another, as illustrated in FIG. 4, the two openings form a cylindrical opening for receiving the bar. In their closed position, the two sections form a weight having a generally circular border 30 so that the weight can be used for the usual exercise routines.

Hinge means 32 connect the two sections together so that they can be moved between an open position, illustrated in FIG. 2, or a closed position, illustrated in FIG. 4.

Latch means 34 are mounted on the two sections for locking them together in their closed position.

Figure 3:
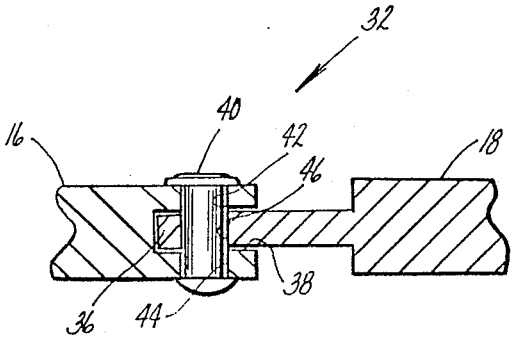
FIG. 3 is an enlarged fragmentary view of the hinge means as seen along lines 3—3 of FIG. 4.

Referring to FIG. 3, hinge means 32 is formed by a narrowed lip 36 of section 18 being received in a slot 38 of section 16. Riveted pin 40 is received through openings 42 and 44 in section 16, and opening 46 in lip 36. The arrangement is such that the two sections are hingedly connected together by the fastener means and can be opened and closed as illustrated in FIGS. 2 and 4.

Figure 6:
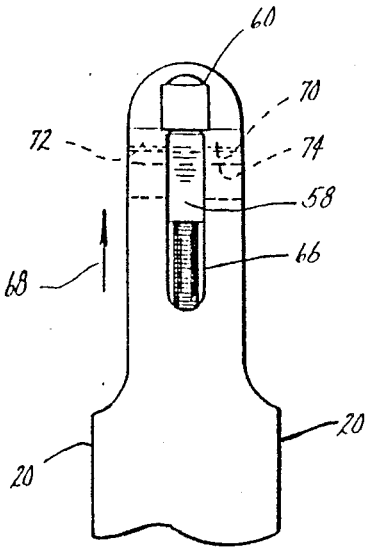
FIG. 6 is an enlarged view of the latch member as seen along lines 6—6 of FIG. 3.
Figure 5:
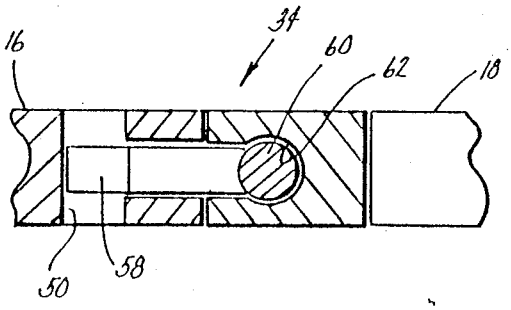
FIG. 5 is an enlarged fragmentary view of the latch means as seen along lines 5—5 of FIG. 4.

Referring to FIGS. 4, 5 and 6, the latch means comprises section 16 having a cavity 50 with an opening 52 on inside edge 54. Opening 52 is defined by a hooked-shaped abutment 56. A hooked-shaped latch 58 is mounted on section 18 and is receivable through opening 52 to a position in which the hook-shaped latch mates with abutment 56 to prevent the two weight sections from being opened.

The latch has a pin-shaped body 60 mounted in a cavity 62 of section 18 so as to be moveable in a direction parallel to edge 64 of the weight section. Weight 18 has a cut-out section 65 providing access to body 60 for moving it and the latch to the unlatched position. Body 60, in its outermost position, is within the circular profile of the weight. A spring bias member 66 urges the body and thereby latch 58 in the direction of arrow 68, toward its locking position in which the hooked-shaped latch engages the hook-shaped abutment.

The sides of cavity 62 have a pair of slots 70 and 72 for receiving the ends of retaining pin 74. The length of the slots define the travel of the latch between open and closed positions. Latch body 60 is depressed with the user's index finger (not shown) against the bias of spring 66. Body 68 is depressed until the latch clears abutment 56 and opening 52 to permit the two weight halves to be opened.

Latch 58 has a cam-shaped section 80 which engages the outside edge of abutment 56 so as to be cammed into opening 52 as the two sections are being closed.

Thus it is to be understood that I have described an improved exercise device having a removable weight which can be opened and closed, and mounted on a bar by a motion transverse to the longitudinal axis of the bar. Further, both the hinge means and the latching means are mounted within the circular profile of the weight. The fastener means are mounted within the profile of the side faces of the weight so that a pair of neighboring weights can be mounted on the bar in a face-to-face relationship.

Having described my invention, I claim:

1. An exercise device, comprising:

a metal bar adapted to support a weight-lifting weight, said bar having a longitudinal axis;

a metal weight suited for weight-lifting exercises, removeably mounted on the bar;

the weight comprising a first weight section, and a second weight section;

the first weight section and the second weight section each comprising a disk-shaped half to collectively form a generally disk-shaped weight formed about a central, cylindrical bar-receiving opening, each of said weight sections having a hub with a greater thickness about said central opening, and a rim of a lesser thickness than said greater thickness;

hinge means connecting the first weight section to the second weight section such that the first weight section is moveable with respect to the second weight section between an open position for receiving the bar in said opening to a metal-to-metal supporting position by a motion in a direction transverse to the longitudinal axis of the bar, and a closed position in which the weight is slidable along the bar but the bar cannot be moved in said transverse direction with respect to the longitudinal axis of the bar;

the first weight section and the second weight section collectively having a circular profile in said closed position;

cooperating latch means mounted on the rims of the first weight section and the second weight section for engaging one another for preventing the opening of said weight sections from said closed position to said open position, the hinge means and the latch means being disposed entirely within the profile of said circular border and within the face-to-face profile of said hubs; and means mounted on the bar for preventing slidable motion of the weight along the bar.

* * * * *